US009096919B2

(12) United States Patent
Blumenau et al.

(10) Patent No.: US 9,096,919 B2
(45) Date of Patent: Aug. 4, 2015

(54) METHOD FOR PRODUCING A FLAT STEEL PRODUCT PROVIDED WITH A METAL PROTECTIVE LAYER BY WAY OF HOT DIP COATING

(75) Inventors: Marc Blumenau, Hagen (DE); Oliver Brehm, Krefeld (DE); Michael Peters, Kleve (DE); Rudolf Schoenenberg, Daphne, AL (US); Andreas Westerfeld, Willich (DE); Martin Norden, Mobile, AL (US)

(73) Assignee: ThyssenKrupp Steel Europe AG, Duisburg (DE)

( * ) Notice: Subject to any disclaimer, the term of this patent is extended or adjusted under 35 U.S.C. 154(b) by 32 days.

(21) Appl. No.: 14/232,089

(22) PCT Filed: Jul. 5, 2012

(86) PCT No.: PCT/EP2012/063069

§ 371 (c)(1),
(2), (4) Date: May 2, 2014

(87) PCT Pub. No.: WO2013/007578

PCT Pub. Date: Jan. 17, 2013

(65) Prior Publication Data

US 2014/0251505 A1 Sep. 11, 2014

(30) Foreign Application Priority Data

Jul. 11, 2011 (DE) ..... 10 2011 051 731

(51) Int. Cl.

| | |
|---|---|
| ***C22C 38/02*** | (2006.01) |
| ***C23C 2/02*** | (2006.01) |
| ***C21D 1/74*** | (2006.01) |
| ***C21D 6/00*** | (2006.01) |
| ***C22C 38/04*** | (2006.01) |
| ***C22C 38/06*** | (2006.01) |
| ***C22C 38/18*** | (2006.01) |

(Continued)

(52) U.S. Cl.

CPC ... *C23C 2/02* (2013.01); *C21D 1/74* (2013.01); *C21D 6/005* (2013.01); *C21D 8/0263* (2013.01); *C21D 8/0278* (2013.01); *C22C 38/02* (2013.01); *C22C 38/04* (2013.01); *C22C 38/06* (2013.01); *C22C 38/18* (2013.01); *C22C 38/22* (2013.01); *C22C 38/38* (2013.01); *C23C 8/10* (2013.01); *C21D 8/0226* (2013.01); *C21D 8/0236* (2013.01)

(58) Field of Classification Search

CPC ..... C23C 2/02; C23C 8/10; C21D 1/74; C21D 6/005; C21D 8/0263; C21D 8/0226; C21D 8/0278; C22C 38/02; C22C 38/06; C22C 38/18; C22C 38/22; C22C 38/38

See application file for complete search history.

(56) References Cited

U.S. PATENT DOCUMENTS

| | | | |
|---|---|---|---|
| 3,925,579 | A | 12/1975 | Flinchum et al. |
| 8,481,172 | B2 | 7/2013 | Warnecke et al. |

(Continued)

FOREIGN PATENT DOCUMENTS

| | | | |
|---|---|---|---|
| DE | 2522485 | A1 | 12/1975 |
| DE | 102004047985 | A1 | 4/2006 |

(Continued)

*Primary Examiner* — Lois Zheng
(74) *Attorney, Agent, or Firm* — The Webb Law Firm

(57) ABSTRACT

Optimal wetting and adhesion of the hot-dip coating by way of pre-oxidation in a DFF pre-heating furnace and humidification of the annealing atmosphere in a holding zone is achieved in a hot dip galvanised flat steel product.

15 Claims, 4 Drawing Sheets

(51) Int. Cl.

| | |
|---|---|
| ***C22C 38/22*** | (2006.01) |
| ***C22C 38/38*** | (2006.01) |
| ***C23C 8/10*** | (2006.01) |
| *C21D 8/02* | (2006.01) |

(56) References Cited

U.S. PATENT DOCUMENTS

| | | | |
|---|---|---|---|
| 2009/0188591 | A1 | 7/2009 | Eichelkrauth et al. |
| 2009/0199931 | A1 | 8/2009 | Leuschner et al. |
| 2010/0024925 | A1 | 2/2010 | Warnecke et al. |
| 2010/0173072 | A1 | 7/2010 | Borrel |
| 2012/0125491 | A1 | 5/2012 | Meurer et al. |

FOREIGN PATENT DOCUMENTS

| | | | |
|---|---|---|---|
| DE | 102004059566 | B3 | 8/2006 |
| DE | 102006005063 | A1 | 8/2007 |
| DE | 102006039307 | B3 | 2/2008 |
| DE | 102009018577 | B3 | 7/2010 |
| EP | 1693477 | A1 | 8/2006 |
| EP | 1857566 | A1 | 11/2007 |
| EP | 1936000 | A1 | 6/2008 |
| EP | 2010690 | | 1/2009 |
| EP | 2055799 | A1 | 5/2009 |
| JP | 2004315960 | A | 11/2004 |
| WO | 2007109865 | A1 | 10/2007 |
| WO | 2012028465 | A1 | 3/2012 |

METHOD FOR PRODUCING A FLAT STEEL PRODUCT PROVIDED WITH A METAL PROTECTIVE LAYER BY WAY OF HOT DIP COATING

CROSS-REFERENCE TO RELATED APPLICATIONS

This application is the United States national phase of International Application No. PCT/EP2012/063069 filed Jul. 5, 2012, and claims priority to German Patent Application No. 10 2011 051 731.6 filed Jul. 11, 2011, the disclosures of which are hereby incorporated in their entirety by reference.

BACKGROUND OF THE INVENTION

1. Field of the Invention

The invention relates to a method for producing a flat steel product provided with a metal protective layer by way of hot dip coating, in particular a high-strength flat steel product with a tensile strength of at least 500 MPa or a super high-strength flat steel product with a tensile strength of at least 1,000 MPa.

2. Description of Related Art

Where flat steel products are mentioned below, these are intended to mean any cold- or hot-rolled steel strips, steel sheets, steel sheet blanks or the like, wherein the focus here is in particular on the processing of flat steel products in strip form.

There is an increasing demand for high-strength/super high-strength flat steel products owing to their advantageous combination of strength and formability. This applies in particular to sheet applications in automotive car body construction. The outstanding mechanical properties of such flat steel products are based on a multi-phase microstructure of the material, optionally supported by induced plasticity of austenitic phase fractions (TRIP, TWIP or SIP effect). To obtain such a complex microstructure the flat steel products being discussed here conventionally have significant contents of specific alloy elements, which typically include manganese (Mn), aluminium (Al), silicon (Si) or chromium (Cr). A surface refinement in the form of a metal protective layer increases the resistance of the flat steel products to corrosion and therewith the product life thereof, and also increases their visual impression.

Various methods for applying a metal protective layer are known. These include electrolytic deposition and hot dip coating. In addition to electrolytically produced refinement, hot dip refinement has established itself as an economically and ecologically advantageous method. In the case of hot dip coating the flat steel product to be coated is immersed in a metal molten bath.

Hot dip refinement proves to be particularly cost effective if a flat steel product raw material supplied in the full-hard condition is subjected in a continuous pass to the method steps of cleaning, recrystallization annealing, hot dip coating, cooling, optional thermal, mechanical or chemical post-treatment and winding to form a coil.

The annealing treatment carried out in this way can be used to activate the steel surface. For this purpose a $N_2$—$H_2$ annealing atmosphere with typically unavoidable traces of $H_2O$ and $O_2$ is conventionally maintained in the annealing furnace passed through in one continuous pass.

The presence of oxygen in the annealing atmosphere has the disadvantage that the alloy elements (Mn, Al, Si, Cr, . . . ) with an affinity to oxygen and contained in the flat steel product which is to be treated in each case form selectively passive, non-wettable oxides on the surface of the steel, whereby the quality or adhesion of the coating on the steel substrate can be lastingly impaired. Various attempts have therefore been made to carry out the annealing treatment of high-strength and super high-strength steels of the type in question here such that the selective oxidation of the surface of the steel is largely suppressed.

A first method of this kind is known from DE 10 2006 039 307 B3. In this method for hot dip refinement of steels with 6-30% by weight Mn, the flat steel product which is to be hot dip galvanised is bright annealed under particularly reductive atmospheric conditions (low $H_2O/H_2$ ratio of the annealing atmosphere and high annealing temperature).

EP 1 936 000 A1 and JP 2004 315 960 A each describe method concepts in which the atmospheric conditions in the continuous furnace are set within certain limits and as a function of the temperature of the flat steel product being processed in each case. The internal oxidation respectively of the alloy elements with affinity to oxygen is to be promoted in this way without FeO being formed on the surface of the flat steel product in the process. A precondition of this, however, is exactly matched interaction between the various influencing factors on the annealing gas-metal reaction, such as annealing gas composition and moisture or annealing temperature. For plant-related reasons these are, as a rule, distributed inhomogeneously over the complete furnace chamber. This inhomogeneity makes it difficult to effectively use these processes on a large industrial scale.

Another possibility of preparation of a flat steel product, carried out during the course of an annealing treatment, for hot dip coating consists in that pre-oxidations are carried out in a continuous annealing furnace, used for annealing, within a pre-heating zone and of the DFF type ("DFF"=Direct Fired Furnace). Flames which have been output by gas burners act directly on the flat steel product to be treated in a DF furnace. Since the burners are operated with an excess of $O_2$ (trimming to an air ratio of $\lambda>1$, the oxidation potential of the atmosphere surrounding the flat steel product is adjusted such that a covering FeO layer purposefully forms on the surfaces of the flat steel product. This FeO layer prevents the selective oxidation of the alloy elements, with affinity to oxygen, of the flat steel product. In a second annealing step subsequently carried out in a holding zone the FeO layer is reduced completely again to metal iron.

One approach of this type has been known for a long time from DE 25 22 485 A1. Apart from the effects stated above, the advantage of pre-heating the flat steel product in a pre-heating furnace with a DFF-type construction consists in that particularly high heating rates of the steel strip may be attained, and this significantly reduces the duration of the annealing cycle and can therefore increase the output of the hot dip coating plant coupled to a corresponding continuous furnace. The adjustment of an FeO layer thickness of 20-200 nm, regarded as optimal, in an homogeneous, uniform distribution over the strip width can only be controlled with difficulty, however, by way of trimming of the DFF burner flames. An FeO layer which is either too thin or too thick can lead to wetting and adhesion problems.

Very uniform pre-oxidation owing to direct strip contact with an envelope flame allows what is known as a "DFI booster" ("DFI"=Direct Flame Impingement), as is described in DE 10 2006 005 063 A1. However, the use of such a DFI booster is possible only under certain structural conditions, and these do not exist in many current hot dip coating plant.

Methods are also known from EP 2 010 690 B1 and DE 10 2004 059 566 B3 in which an FeO layer is produced on the surface of the respectively processed flat steel product by feeding 0.01-1 vol. % $O_2$ over a period of 1-10 s into a closed reaction chamber. The installation of such a reaction chamber is possible only in an indirectly heated RTF furnace, however, in which the flat steel product is heated by way of heat radiation ("RTF": Radiant Tube Furnace).

Finally it is known from US 2010/0173072 A1 that the dew point of the oxidation atmosphere can be adjusted in an annealing furnace by targeted humidification in such a way that the desired inner oxidation of the alloy elements of the respectively processed flat steel product is ensured. The pre-oxidation of the flat steel product is carried out in this case in an indirectly heated furnace of the RTF type.

Against the background of the prior art described above, the object of the invention lay in developing a method with which high-strength and super high-strength steels with significant alloy contents of alloy elements with affinity to oxygen (Mn, Al, Si, Cr, . . . ) may be cost- and resource-effectively hot dip galvanised on a continuously operating plant.

SUMMARY OF THE INVENTION

Advantageous embodiments and variants of the invention will be described in detail below along with the general inventive idea.

A method according to the invention for producing a flat steel product, provided with a metal protective layer by way of hot dip coating, accordingly comprises the following steps:

a) providing a cold- or hot-rolled flat steel product which in addition to Fe and unavoidable impurities (in % by weight) contains up to 35.0% Mn, up to 10.0% Al, up to 10.0% Si, up to 5.0% Cr, up to 2.0% Ni, up to 0.5% Ti, V, Nb, Mo respectively, up to 0.1% S, P and N respectively, up to 1.0% C;

b) optional cleaning of the flat steel product, c) heating the flat steel product to a 600-1,100° C. holding temperature, wherein heating c.1) occurs within a heating time of 5-60 s c.2) in a pre-heating furnace of the DFF type;

c.3) in which a pre-oxidation section is constructed in which the flat steel product has a pre-oxidation temperature of 550-850° C. and in which the flat steel product is exposed for 1-15 s to an oxidising atmosphere with an oxygen content of 0.01-3.0 vol. %, which by blowing a stream of gas containing oxygen into the flame of at least one burner associated with the pre-oxidation section is introduced into the pre-oxidation atmosphere to form a covering FeO layer on the surface of the flat steel product;

c.4) whereas outside of the pre-oxidation section an atmosphere prevails in the pre-heating furnace which is reducing or neutral with respect to the surface of the steel and consists of $N_2$ and additionally 5-15 vol. % $CO_2$, 0.1-2.0 vol. % CO and in total at most 10 vol. % $H_2$, $O_2$ and $H_2O$;

d) recrystallising annealing of the flat steel product by holding the flat steel product at the holding temperature in an annealing furnace for a holding period of 30-120 s, the product then being passed through the pre-heating furnace to bring about recrystallisation of the flat steel product, wherein d.1) an annealing atmosphere prevails in the annealing furnace which has a reducing effect with respect to FeO and contains 0.01-85.0 vol. % $H_2$, in total up to 5 vol. % $H_2O$, less than 0.01 vol. % $O_2$ and $N_2$ as the remainder, and d.2) the dew point of the annealing atmosphere is held between −40° C. and +25° C. over the entire path of the flat steel product through the annealing oven in that losses or irregularities in the distribution of the moisture of the atmosphere are compensated by supplying moisture by means of at least one humidifier;

e) cooling the flat steel product to a bath entry temperature of 430-800° C., wherein cooling occurs under a cooling atmosphere which consists up to 100% of $N_2$ and, if present, of H, and unavoidable impurities as the remainder;

f) optional holding of the flat steel product for 5-60 s at the bath entry temperature and under the cooling atmosphere;

g) introducing the flat steel product into a molten bath whose temperature is 420-780° C., wherein in the transition region to the molten bath the cooling atmosphere is maintained and the dew point of the cooling atmosphere is adjusted to −80° C. to −25° C.;

h) passing the flat steel product through the molten bath and adjusting the thickness of the metal protective layer on the flat steel product issuing from the molten bath, i) optional heat treatment of the flat steel product provided with the metal protective layer.

According to the invention the respectively provided flat steel product is therefore heat-treated in a continuous process on a hot dip coating plant with DFF pre-heater and a holding zone, is cooled immediately thereafter and surface-refined in-line. Depending on the intended use a zinc, zinc/aluminium, zinc/magnesium, aluminium or aluminium/silicon hot dip coating can be applied to the flat steel product in this connection. Coatings of this kind are conventionally also denoted by way of example by the abbreviated designations "Z", "ZF", "ZM", "ZA", "AZ", "AS". Wetting and adhesion that satisfy the highest demands by way of the hot dip coating are ensured in that the respective flat steel product is prepared during the course of the method according to the invention by way of purposeful combination of a particularly homogenous pre-oxidation in the DFF pre-heater and targeted humidification of the annealing atmosphere in the holding zone such that the surface of the flat steel product is largely free from disruptive oxides on entry into the respective coating bath.

The flat steel product processed according to the invention and provided in the hot- or cold-rolled state typically has a thickness of 0.2-4.0 mm and apart from Fe and unavoidable impurities contains (in % by weight):

- up to 35% Mn, in particular up to 2.5% Mn, wherein Mn contents of at least 0.5% are typical,
- up to 10.0% Al, in particular up to 2.0% Al, wherein if Al is present in effective contents, Al contents of at least 0.005% are typical,
- up to 10.0% Si, in particular up to 2.0% Si, wherein if Si is present in effective contents, Si contents of at least 0.2% are typical,
- up to 5.0% Cr, in particular up to 2.0% Cr, wherein if Cr is present in effective contents, Cr contents of at least 0.005% are typical,
- Ni contents of up to 2.0%, wherein if Ni is present in effective contents, Ni contents of at least 0.01% are typical,
- contents of Ti, V, Nb, Mo of up to 0.5% respectively, wherein if Ti, V, Nb, Mo is present in effective contents, the content of these elements is at least 0.001% respectively,
- optional contents of B of 0.0005-0.01%,
- contents of S, P, N of up to 0.1% respectively, and
- C contents of up to 1.0%, in particular at least 0.005%, wherein the upper limit of the C content is limized to 0.2%.

The flat steel product provided in this way is, if required, subjected to a conventionally performed cleaning process.

The flat steel product is then heated within a heating time of 5-60 s, in particular 5-30 s, in a pre-heating furnace of the DFF type to a holding temperature of 600-1,100° C., in particular 750-850° C. A heating time of at least 5 s is necessary to heat the flat steel product to the required minimum temperature of 600° C. A heating time of a maximum of 60 s should not be exceeded to adjust an initial structure optimum for the annealing process.

Heating times which go beyond this harbour the risk of not attaining the required mechanical properties in the end product. A reduction in the heating time to a maximum of 30 contributes to an improvement in the plant output and the economic efficiency of the process.

An atmosphere which is reducing or neutral with respect to the surface of the steel is maintained in the DFF pre-heater, and this substantially comprises $N_2$ and additionally 5-15 vol. % $CO_2$, 0.1-2.0 vol. % CO and in total at most 10 vol. % $H_2$, $O_2$ and $H_2O$. Even with up to 10 vol. % $H_2$+$O_2H_2$+O in total the oxygen content in the atmosphere is so low that the atmosphere is neutral or reducing with respect to the iron in the steel substrate.

In a process window in which the flat steel product is 550-850° C., in particular 600-700° C., the flat steel product is exposed during the heating phase for 1-15 s to a pre-oxidation atmosphere which contains 0.01-3.0 vol. % Oz. Pre-oxidation should be performed at temperatures of at least 550° C., because it is only above this temperature that the selective oxidation of the alloy elements which is to be prevented by pre-oxidation begins. Pre-oxidation is performed at temperatures up to a maximum of 850° C. because at higher temperatures the oxide layer is too thick.

Experiments have shown that pre-oxidation in the temperature range of 600-700° C. provides optimum coating results. A 20-300 nm, optimally 20-200 nm, thick FeO layer forms on the respectively processed flat steel product under the pre-oxidation atmosphere, and this layer completely covers the surface of the steel. Temperatures of at least 600° C. are required in this connection to attain sufficient recrystallization of the basic material. At the same time, temperatures of a maximum of 1,100° C. should not be exceeded to avoid coarse grain formation. The holding temperature is preferably 750-850° C. because this constitutes the optimum production range with respect to plant utilisation and economic efficiency of the process.

The relevant process window within the heating phase can be achieved in that at least one of the burners associated with the pre-oxidation zone is operated with an $O_2$ excess ($\lambda$>1). The aim here is to produce a very homogeneous FeO layer of uniform thickness on the flat steel product.

For this purpose an appreciable flow of $O_2$ or air can be blown separately into the flame by means of what is known as a "jet pipe". An example of such a jet pipe is described in DE 10 2004 047 985 A1. Jet pipes allow a highly concentrated stream of gas to be applied with a high flow speed and correspondingly high kinetic energy. The flow of gas applied by the jet pipe and directed according to the invention into the burner flame causes significant turbulence of the burner flame. The distribution of the gas components, in particular of the oxygen blown into the pre-heating furnace is substantially homogenised over the cross-section of the furnace in this way. An optimum effect results if the blow-in speed of the flow of gas is set to 60-180 m/s. The temperature of the blown-in gas can be up to 100° C. above the pre-oxidation temperature in this case.

Optimally at least two burners are used in the pre-heating furnace, of which one is associated with the top and the other with the bottom of the respectively processed flat steel product.

Alternatively, it is also conceivable to produce the required oxygen excess in the pre-oxidation atmosphere by means of a DFI booster, which is fitted with at least one ramp associated with the top and one ramp associated with the bottom of the flat steel product and which is operated with an $O_2$ excess ($\lambda$>1). A "ramp" in this connection designates the frame occupied by burner nozzles which guide the flames directly toward the surface of the flat steel product associated with them in each case such that the flat steel product is enveloped by the burner flames.

If required an additional DFI booster can be connected upstream of the DFF pre-heating furnace, and this uniformly and quickly heats the steel strip without the need for pre-oxidation, and improves strip cleaning. The plant output can also be increased thereby.

After heating to the holding temperature the flat steel product pre-oxidised according to the invention passes for 30-120 s, in particular 30-60 s, through an annealing furnace, connected to the pre-heating furnace, in which it is subjected to recrystallisation annealing at the respective holding temperature. The annealing furnace in which holding at the holding temperature is carried out is typically of the RTF design. The minimum pass-through time of 30 s is necessary to completely recrystallize the material. The maximum pass-through time of 120 s should not be exceeded in order to prevent coarse grain formation. A pass-through time of 30-60 s proves to be advantageous not just with regard to optimum furnace throughput and likewise optimum plant utilisation for economic reasons, but also to prevent external oxidation of the alloy elements (Mn, Si, Al, Cr, . . . ) of the steel substrate after detachment of the FeO layer, which occurs as a result of the atmosphere with a reducing effect on Fe.

The annealing gas atmosphere prevailing in the annealing furnace comprises 0.01-85.0 vol. % $H_2$, up to % vol. % $H_2O$, less than 0.01 vol. % $O_2$ and $N_2$ as the remainder. The preferred range for the hydrogen content is 3.0-10.0 vol. %. Above 3 vol. % hydrogen in the atmosphere it is possible to adjust a sufficient reduction potential with respect to FeO even with short annealing periods. Contents of less than or equal to 10.0 vol. % hydrogen are preferably adjusted to save resources and to reduce $H_2$ consumption.

The dew point "TP" of the annealing atmosphere is held at −40° to +25° C. On the one hand the dew point is −40° C. or more to minimise the driving force of the external oxidation of the alloy elements (for example Mn, Al, Si, Cr). On the other hand undesired oxidation of iron is avoided by a dew point of a maximum of +25° C. In experiments it could be shown that particularly good surface results are established at a dew point of at least −30° C. At the same time the dew point is preferably 0° C. at most to minimise the risk of surface decarburisation.

The annealing parameters of the recrystallizing annealing are accordingly set overall such that during annealing a reduction in FeO, which has been formed during the course of the preceding pre-oxidation (step c)) on the surfaces of the flat steel product, is induced. At the outlet of the annealing furnace the flat steel product annealed according to the invention has a surface substantially comprising metallic iron.

It is crucial to this result that the dew point of the annealing atmosphere never drops below −40° C. over the entire path of the flat steel product through the annealing furnace, wherein the desired condition of the surface of the flat steel product is particularly reliably established if the dew point is held above −30° respectively. With a dew point below the critical value of −40° C. external oxidation of the alloy elements of the flat steel product with affinity to oxygen can occur, whereby the undesired oxides which affect wetting or adhesion of the metal coating could form on the flat steel product.

This effect is prevented with the method according to the invention by the reduction, carried out according to the invention in the annealing furnace, of the FeO present on the pre-oxidised flat steel product in combination with targeted humidification of the annealing furnace section.

The FeO layer, which is still fully present on the pre-oxidised flat steel product on entry into the annealing furnace, is converted by the incipient reduction by way of the $H_2$ contained in the annealing atmosphere, with formation of gaseous $H_2O$, into metallic iron. Since there is increasingly less FeO on the flat steel product over the conveying path covered in the annealing furnace in the direction of the outlet of the annealing furnace and the resultant water vapour is erratically distributed in the annealing furnace for plant-related reasons, according to the invention at least one humidifier is provided with which moisture can be purposefully supplied to the annealing atmosphere to compensate moisture losses or irregularities.

A flow of gas typically flows through annealing furnaces used for recrystallizing annealing of a flat steel product.

The flow is directed from the outlet of the furnace in the direction of its inlet and counter to the conveying direction of the flat steel product to be treated in each case. It is therefore particularly expedient to arrange the at least one humidifier provided for the targeted supply of moisture adjacent to the outlet of the annealing furnace. This arrangement leads not only to uniform distribution of the moisture, assisted by the flow of gas, but also takes account of the fact that the amount of water vapour produced by the reduction in the FeO covering of the flat steel product constantly decreases in the direction of the outlet of the annealing furnace and the dew point could accordingly drop below the critical value without the supply of additional moisture. As a result the targeted introduction of moisture into the annealing atmosphere ensures an atmosphere over the entire length of the conveying path through the annealing furnace whose dew point is always above the critical threshold value.

The humidifier provided according to the invention can comprise a slotted or perforated pipe, wherein a pipe of this kind is in each case optimally arranged so as to be oriented transversely to the conveying direction of the flat steel product above and below the conveying path. The individual plant design can make it necessary to install additional humidifiers distributed over the length of the holding zone to ensure the desired homogeneity of the annealing atmosphere in relation to the dew point.

Steam or humidified $N_2$ or $N_2$—$H_2$ gas is expedient as the carrier medium for the fed-in moisture.

The dew point and the dew point distribution in the annealing furnace can also be regulated by way of control of the carrier gas volumetric flow fed-in in each case or the speed of the flow of gas within the annealing furnace.

The speed of the stream of gas flowing through the annealing furnace can be manipulated in that the pressure drop between the outlet region of the annealing furnace and an extraction system is changed, the extraction furnace typically being positioned at the start of the pre-heating furnace. This change can occur by way of control of the suction output or the volume of annealing gas fed into the furnace chamber. The pressure drop is conventionally set to values of 2-10 mmWs.

To prevent $H_2$ passing out of the annealing furnace and into the region of the pre=heating furnace and impeding the desired oxidation of the flat steel product by way of a parasitic reaction of the penetrating $H_2$ with the $O_2$ present in the pre-oxidation atmosphere, the pre-heating furnace should be separated from the annealing furnace such that the $H_2$ volume fractions potentially discharged from the annealing furnace and flowing in the direction of the pre-heating furnace are bound before reaching the pre-oxidation zone. For this purpose a flow of gas containing $O_2$, by way of example in the form of a pure $O_2$ flow of gas or a flow of air, can be introduced at the start of the annealing furnace in the region of the transition from the pre-heating furnace to the annealing furnace to react $H_2$ penetrating into this region from the annealing furnace to $H_2O$. In the process the volume of $O_2$ respectively fed in is regulated in such a way that as far as possible no $H_2$ can be meteorologically detected in the, as a rule, tunnel-like transition region between pre-heating furnace and annealing furnace.

Alternatively or additionally, the targeted reaction of hydrogen which has passed into the pre-heating furnace can also occur in that at least one final burner, arranged in the vicinity if the outlet of the pre-heating furnace, of the pre-heating furnace is operated with such a high excess of $O_2$ that as a result of this surplus the excess $O_2$ fraction in the pre-oxidation atmosphere in turn binds the hydrogen optionally penetrating into the pre-heating furnace to water vapour.

Following recrystallizing annealing under the annealing atmosphere which has a reducing effect in relation to the FeO present on the flat steel product after pre-oxidation the flat steel product, which now has an active surface substantially comprising metallic iron, is cooled to the required bath entry temperature. The bath entry temperature is varied between 430 and 800° C. as a function of the type of coating bath. In the case where the flat steel product is to be hot dip galvanised with a metal protective layer based on zinc, the bath entry temperature is therefore typically 430-650° C. and the temperature of the molten bath is in the range of 420-600° C. If, on the other hand, the flat steel product is to be hot dip galvanised with a metal protective layer based on aluminium, bath entry temperatures of the flat steel product of 650-800° C. are typically chosen in the case of molten bath temperatures of 650-780° C.

An ageing treatment extending over 5-60 s after cooling can optionally follow at the bath entry temperature. Such an ageing treatment is expedient in the case of some steels to adjust the microstructures necessary to achieve the required material properties. This is the case for example with TRIP steels in which time and temperature are provided for diffusion of the carbon by way of the ageing treatment.

The flat steel product cooled to the bath entry temperature is led into the metallic molten bath while avoiding contact with an atmosphere containing oxygen, in particular the surrounding atmosphere. What is known as a nozzle is conventionally used for this purpose, and this is connected to the end of the cooling zone or the optionally present ageing zone of the annealing furnace and immerses with its free end into the molten bath. A protective gas atmosphere comprising 100% $N_2$, $N_2$ with up to 50.0 vol. %, in particular up to 10 vol. % $H_2$ or 100% $H_2$, which has a non-reactive or reducing effect with respect to the steel strip, prevails in the cooling zone, the optionally present ageing zone and in the nozzle. An addition of hydrogen to the protective gas atmosphere in the nozzle is not basically necessary. It does prove to be advantageous, however, as a function of strip speed and strip measurements, to avoid coating defects due to top drosses. An addition of hydrogen of up to 10 vol. % has proven to be particularly advantageous in this connection.

Inside the nozzle the dew point should be between −80 and −25° C., in particular −50° and −25° C. The dew point of the protective gas atmosphere in the nozzle should not be below −80° C. because the atmosphere will be too dry below this temperature. This could lead to formation of dust, whereby the coating result would, in turn, be adversely affected. At the same time the dew point of the protective gas atmosphere in the nozzle should not be above −25° C. as otherwise the atmosphere would be too moist, and this would, in turn, entail increased dross formation. A minimised risk of dust formation and simultaneously high process stability result if the dew point in the nozzle is between −50° and −25° C.

The flat steel product led into the molten bath in this way passes through the molten bath within a 1-10 s, in particular 2-5 s, dwell time. Since the pass-through time is at least 1 s it is ensured that a reactive wetting between surface of the steel and coating bath proceeds in the molten bath. The pass-through time should not be longer than 10 s to avoid undesirable alloying of the coating. The period of 2-5 s for the pass-through time has proven to be particularly suitable in ensuring a surface finish which is optimised with respect to the coating and adhesion result.

The composition of the molten bath is guided by the respective guidelines of the end user and can be made up by way of example as follows (all contents are in % by weight):

i) what are known as "Z", "ZA", "AZ" coatings:

0.1-60%, in particular 0.15-0.25%, Al, up to 0.5% Fe and Zn and unavoidable impurities as the remainder, including traces of Si, Mn, Pb and rare earths;

ii) what are known as "ZM coatings":

0.1-8.0% Al, 0.2-8.0 Mg, less than 2.0% Si, less than 0.1% Pb, less than 0.2% Ti, less than 1% Ni, less than 1% Cu, less than 0.3% Co, less than 0.5% Mn, less than 0.1% Cr, less than C.5% Sr, less than 3.0% Fe, less than 0.1% B, less than 0.1% Bi, less than 0.1% Cd, remainder Zn and unavoidable impurities, including traces of rare earths, wherein % Al/% Mg <1 should apply for the ratio % Al/% Mg of the respective Al content % Al to the respective Mg content % Mg;

iii) coatings of the type documented in EP 1 857 566 A1, EP 2 055 799 A1 or EP 1 693 477 A1;

iv) what are known as AS coatings:

less than 15% Si, less than 5.0% Fe, remainder Al and unavoidable impurities, including traces of Zn and rare earths.

On exiting the molten bath the thickness of the metal protective layer present on the flat steel product which has issued from the molten bath is conventionally adjusted. Devices which are known per se, such as stripping air knives or the like, can be used for this purpose.

If what is known as a "galvannealing product" is to be provided, the hot dip galvanised flat steel product can be after-treated inline following the hot dip galvanisation to produce a Fe—Zn alloy coating ("ZF coating"). In this case a molten bath which contains 0.1-0.15% by weight Al and up to 0.5% by weight Fe in addition to zinc and unavoidable impurities, including traces of Si, Mn and Pb has proven to be expedient.

BRIEF DESCRIPTION OF THE DRAWINGS

The invention will be described in more detail below with reference to embodiments. In the drawings, schematically in each case.

DESCRIPTION OF THE INVENTION

Figure 1:
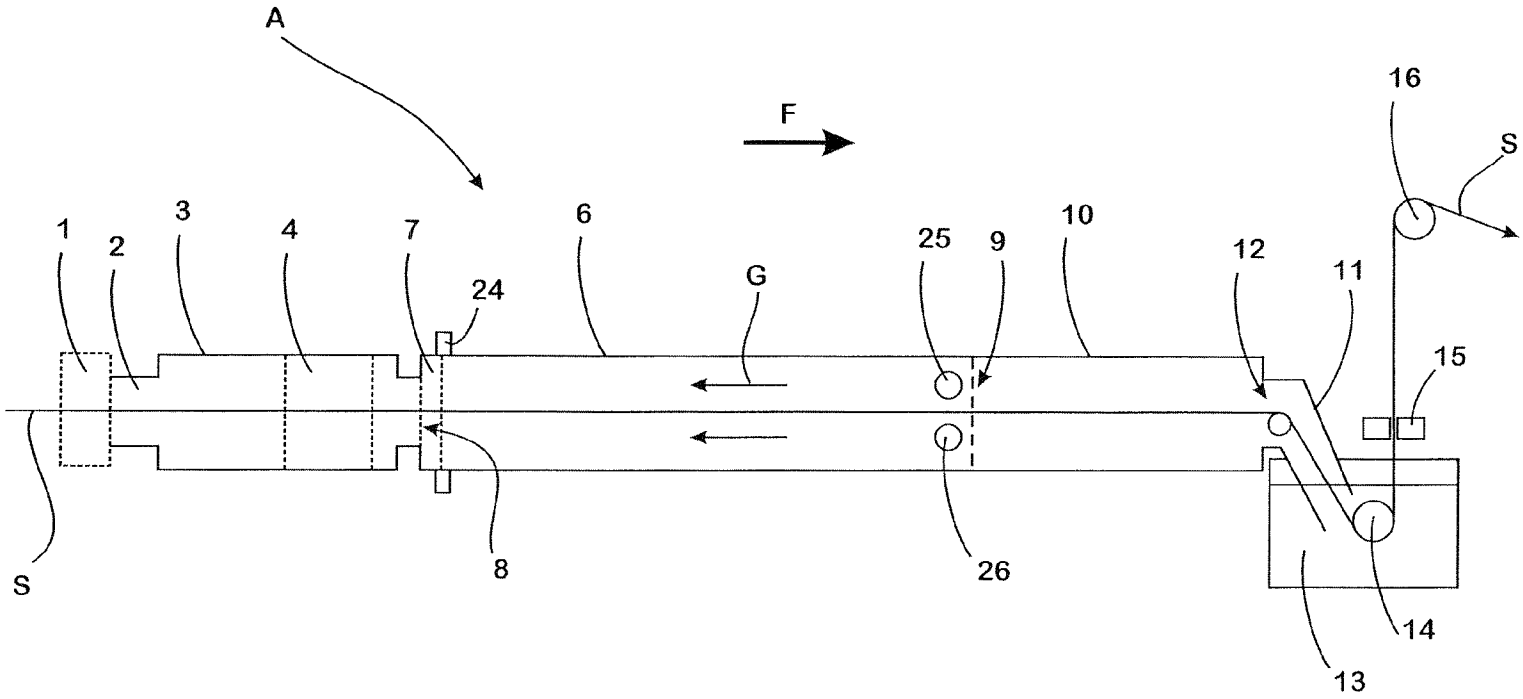
FIG. 1 shows a hot dip coating plant suitable for carrying out the method according to the invention.

In the horizontally oriented conveying direction F of the flat steel product S, in the form of a steel strip, which is to be coated, the hot dip coating plant A has, directly adjoining one another, a DFI booster 1 optionally provided for pre-heating the flat steel product S, a pre-heating furnace 3 connected by its inlet 2 to the DFI booster, a pre-oxidation section 4 being constructed in the furnace 3, an annealing furnace 6 which is connected by a transition region 7 to the outlet 8 of the pre-heating furnace 3, a cooling zone 10 connected to the output 9 of the annealing furnace 6, a nozzle 11 connected to the cooling zone 10, and which is connected to the outlet 12 of the cooling zone 10 and immerses with its free end into a molten bath 13, a first deflector 14 arranged in the molten bath 13, a device 15 for adjusting the thickness of the metal coating applied to the flat steel product S in the molten bath 13, and a second deflector 16.

The pre-heating furnace 3 is of the DFF type. Burners (not shown in FIG. 1 for the sake of clarity) are arranged in the pre-heating furnace 3 distributed over its conveying section. One group of these burners is associated with the bottom and another group with the top of the flat steel product S to be coated. Outside of the pre-oxidation section 4 the burners are conventionally constructed and are supplied with the required fuel gas and oxygen in a known manner.

Figure 2:
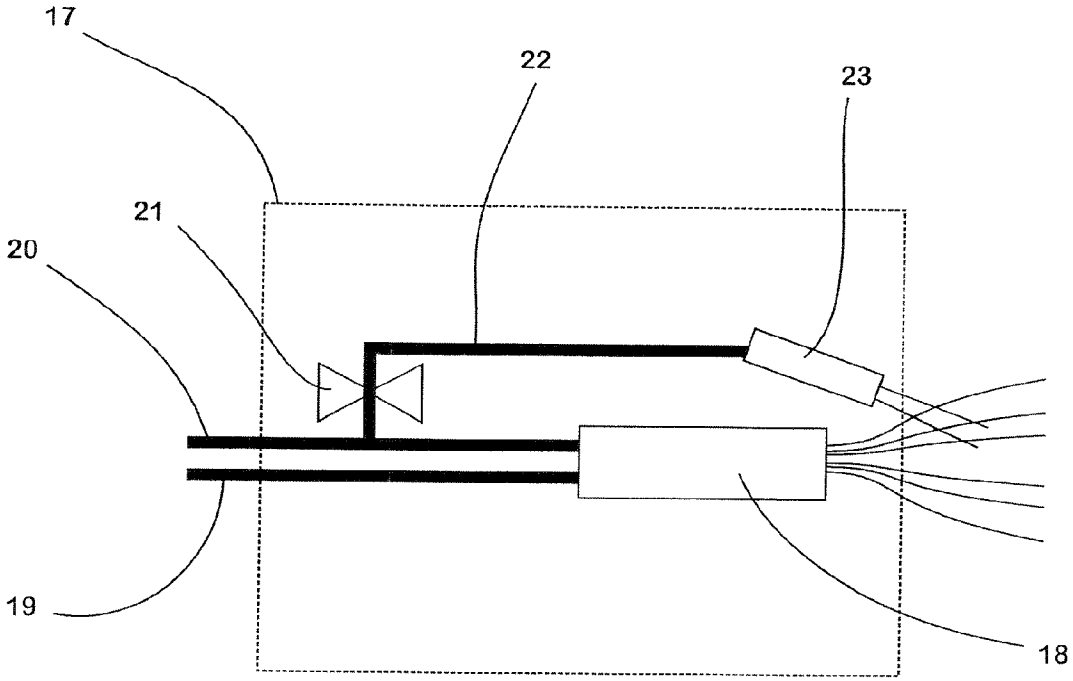
FIG. 2 shows a combination comprising burner and jet pipe, used in the hot dip coating plant according to FIG. 1, to produce a particularly homogenous $O_2$ distribution within the flame for the purpose of pre-oxidation.
Figure 3:
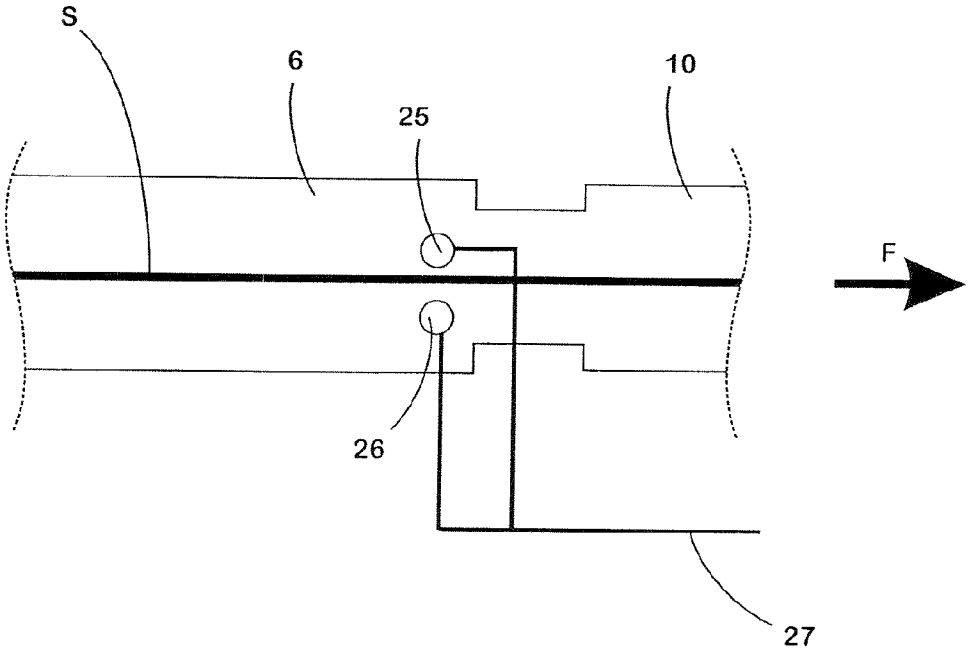
FIG. 3 shows a diagram of a humidifier installed according to the invention for targeted humidification of the annealing furnace atmosphere.
Figure 4:
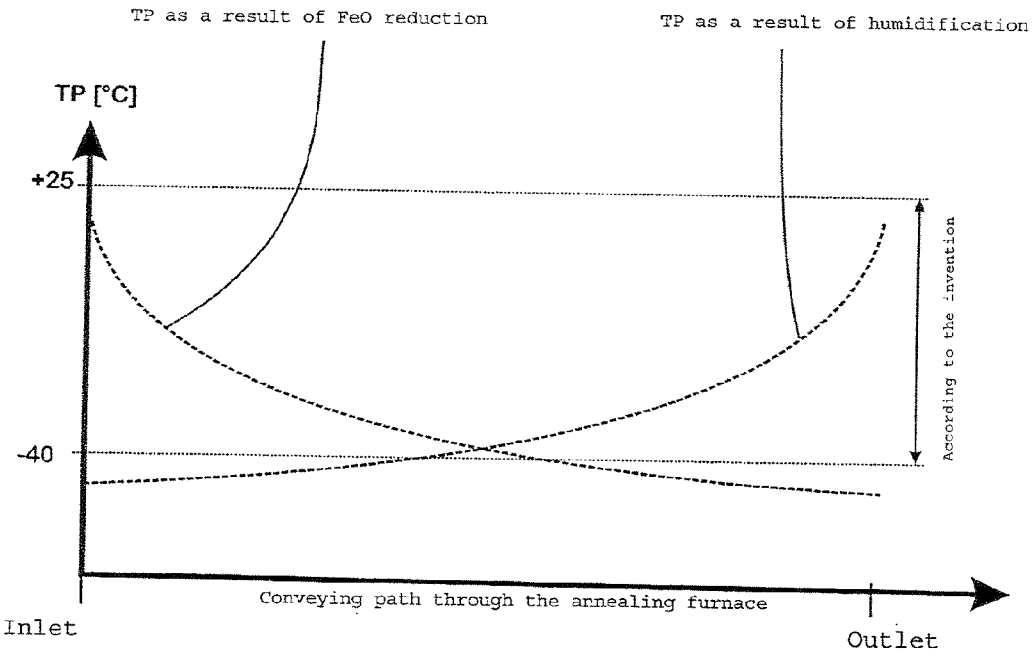
FIG. 4 shows a graph of the dew point stabilisation according to the invention above the critical dew point limit over the entire length of the annealing furnace through combined use of targeted pre-oxidation (dew point as a result of FeO reduction) and humidification (dew point as a result of humidification).

In the region of the pre-oxidation section 4 the burners form with a respective jet pipe burner/jet pipe combination 17 of the type shown in FIG. 2. The burners 18 of the burner/jet pipe combinations 17 are each connected by a fuel gas line 19 to a fuel gas supply (not shown here) and by an oxygen supply line 20 to an oxygen supply (not shown here either). Before entering the burner 18 an oxygen junction line 22 is in each case connected to the oxygen supply line 20 by a control valve 21. The oxygen junction line 22 in each case leads to a jet pipe 23, configured in the manner of the prior art mentioned in DE 10 2004 047 985 A1, which directs the oxygen gas jet issuing from it at a high flow energy and concentration into the burner flame. Strong turbulence of the burner flame, and therewith an intensive contact of the burner flame and the pre-oxidation atmosphere prevailing in the pre-oxidation zone, with the flat steel product S to be coated is brought about in this way.

A device (likewise not shown here in detail) for the targeted feeding-in of oxygen or air is provided in the transition region 7. For the purpose of this feeding-in is the binding of hydrogen, which potentially passes as a result of the stream of gas G, flowing in the annealing furnace 6 from its outlet 9 in the direction of its inlet, into the transition region 7. At the same time an extraction system 24 is arranged in the region of the inlet of the annealing furnace 6 and this extracts the flow of gas G arriving at the inlet of the annealing furnace.

Adjacent to the outlet 9 of the annealing furnace 6 are arranged two humidifiers 25, 26, of which one is associated with the top and the other with the bottom of the flat steel product S to be coated. The humidifiers 25, 26 are designed as slotted or perforated pipes oriented transversely to the conveying direction F of the flat steel product S and are connected to a supply line 27 via which the humidifiers 25, 26 are supplied with water vapour or a humidified carrier gas, such as $N_2$ or $N_2/H_2$.

The cooling zone 10 can be designed in such a way that, before its entry into the nozzle 11, the flat steel product S cooled to the respective bath entry temperature passes, while still in the cooling zone 10, through an ageing treatment at the bath entry temperature.

In the molten bath 13 the flat steel product S is deflected at the first deflector 14 in the vertical direction and passes through the device 15 for adjusting the thickness of the metal protective layer. The flat steel product provided with the metal protective layer is then deflected at the second deflector 16 into the horizontal conveying direction F again and is optionally subjected to further treatment steps in plant parts not shown here.

In a coating line corresponding to hot dip plant A various samples of flat steel products were hot dip galvanised in tests V1-V14 with a metal protective layer to verify the effect of the method according to the invention.

The hot dip galvanised samples each consisted of one of the high-strength/super high-strength steels S1-S7 whose composition is given in Table 1.

TABLE 1

| Steel | C | Mn | Si | Cr | Al | Mo |
|---|---|---|---|---|---|---|
| S1 | 0.23 | 1.60 | 0.12 | 0.05 | 1.00 | 0.004 |
| S2 | 0.07 | 1.45 | 0.11 | 0.49 | 0.03 | <0.002 |
| S3 | 0.12 | 1.75 | 0.10 | 0.50 | 1.30 | 0.100 |
| S4 | 0.22 | 1.75 | 0.10 | 0.10 | 1.55 | 0.100 |
| S5 | 0.16 | 1.60 | 1.60 | 0.06 | 0.05 | 0.010 |
| S6 | 0.15 | 1.85 | 0.25 | 0.70 | 0.70 | <0.002 |
| S7 | 0.24 | 1.22 | 0.25 | 0.13 | 0.03 | <0.002 |

All details in % by weight, remainder iron and unavoidable impurities

Table 2 gives the test parameters set during the tests for the hot dip refinement of the investigated samples. The following designations apply here:

| | |
|---|---|
| Steel | = chemical alloy composition of the flat steel product according to Table 1 |
| T1 | = pre-oxidation temperature in ° C. |
| Atm1 | = composition of the pre-oxidation atmosphere during the pre-oxidation step (the % details denote the contents of the respective components in vol. %) |
| T2 | = holding temperature in ° C. |
| Atm2 | = composition of the annealing atmosphere during holding (the % details denote the contents of the respective components in vol. %) |
| TP1 | = dew point at the start of the annealing furnace in ° C. |
| TP2 | = dew point in the middle of the annealing furnace in ° C. |
| TP3 | = dew point at the end of the annealing furnace in ° C. |
| B | = active annealing furnace humidification switched on? |
| T4 | = strip entry temperature in ° C. |
| Atm3 | = atmosphere composition of nozzle zone (the % details denote the contents of the respective component in vol. %) |
| TP4 | = dew point of the cooling atmosphere in the nozzle zone in ° C. |
| Bath | = molten bath composition (details in % by weight) |
| Galv | = has a thermal after-treatment (galvannealing) been carried out? |

The assessments of the coating results are summarised in Table 3. They clearly prove that application of the method according to the invention produces optimum results whereas flat steel products which are not produced according to the invention have deficiencies.

Owing to its mechanical properties and its surface properties a flat steel product hot dip galvanised according to the inventive method is eminently suitable for being processed further by means of a one-, two- or multi-stage cold- or hot-forming process to produce a high-strength/super high-strength sheet metal component. This primarily applies to applications in the automotive industry but also to apparatus construction, mechanical engineering and household appliance engineering as well as the construction industry. In addition to the outstanding mechanical component properties a sheet metal component of this kind is also characterised by particular resistance to environmental factors. Use of a flat steel product hot dip galvanised according to the invention therefore extends the product life in addition to increasing the potential for lightweight construction.

To summarise it can be said that the method according to the invention means optimum wetting and adhesion of the hot dip coating by way of pre-oxidation in a DFF pre-heating furnace and humidification of the annealing atmosphere can be achieved in a holding zone in the case of a hot dip galvanised flat steel product. For this purpose the 550-850° C. flat steel product is firstly exposed in a pre-oxidation section of the DFF furnace within 1-15 s to an oxidising atmosphere introduced by blowing a flow of gas containing oxygen into the flame of a burner to form a covering FeO layer on the surface of the product, whereas outside of the pre-oxidation section in the DFF furnace an atmosphere prevails which is reducing or neutral with respect to the surface of the steel. The flat steel product heated to a holding temperature of 600-1,100° C. is then annealed in a recrystallizing manner under an FeO-reducing atmosphere, the dew point of which is held at −40° C. to +25° C. by the addition of moisture, cooled under an atmosphere with <100% $N_2$ and a dew point of −80° C. to −25° C. to a bath entry temperature of 420-780° C. and led through a molten bath.

List of Reference Characters

1 DFI booster
2 inlet 2 of the pre-heating furnace 3
3 pre-heating furnace
4 pre-oxidation section of the pre-heating furnace 3
6 annealing furnace
7 transition region between the pre-heating furnace 3 and the annealing furnace 6
8 outlet of the pre-heating furnace 3
9 outlet of the annealing furnace 6
10 cooling zone
11 nozzle
12 outlet of the cooling zone 10
13 molten bath
14 deflector
15 device for adjusting the thickness of the metal coating applied to the flat steel product S in the molten bath 13
16 deflector
17 burner/jet pipe combinations
18 burner
19 fuel gas line
20 oxygen supply line
21 control valve
22 oxygen junction line
23 jet pipe
24 extractor
25, 26 humidifiers
27 supply line
A hot dip coating plan:
F conveying direction of the flat steel product S to be coated
G gas flow
S flat steel product to be coated

TABLE 2

| | Steel | T1 [° C.] | Atm1 | T2 [° C.] | Atm2 | TP1 [° C.] | TP2 [° C.] | TP3 [° C.] | B | T4 [° C.] | Atm3 | TP4 [° C.] | Bath | Galv |
|---|---|---|---|---|---|---|---|---|---|---|---|---|---|---|
| V1 | S1 | 610 | $N_2$ + 0.5% $O_2$ | 791 | $N_2$ + 5% $H_2$ | −5 | −12 | −20 | active | 482 | $N_2$ + 5% $H_2$ | −27 | Zn + O, 18% Al | No |
| V2 | S1 | 650 | $N_2$ + 0.5% $O_2$ | 797 | $N_2$ + 5% $H_2$ | −5 | −12 | −22 | active | 485 | $N_2$ + 5% $H_2$ | −27 | Zn + O, 18% Al | No |
| V3 | S2 | 630 | $N_2$ + 0.8% $O_2$ | 850 | $N_2$ + 5% $H_2$ | −7 | −18 | −25 | active | 483 | $N_2$ + 5% $H_2$ | −29 | Zn + O, 18% Al | No |
| V4 | S2 | *) | $N_2$ | 843 | $N_2$ + 5% $H_2$ | −15 | −30 | −46 | off | 479 | $N_2$ + 5% $H_2$ | −31 | Zn + O, 18% Al | No |
| V5 | S3 | 675 | $N_2$+ 2.5% $O_2$ | 866 | $N_2$ + 5% $H_2$ | −7 | −17 | −23 | active | 480 | $N_2$ + 5% $H_2$ | −27 | Zn + O, 22% Al | No |
| V6 | S3 | 560 | $N_2$+ 5.5% $O_2$ | 850 | $N_2$ + 5% $H_2$ | −15 | −26 | −44 | off | 480 | $N_2$ + 5% $H_2$ | −27 | Zn + O, 22% Al | No |
| V7 | S4 | *) | $N_2$ | 815 | $N_2$ + 10% $H_2$ | −18 | −33 | −51 | off | 476 | $N_2$ + 10% $H_2$ | −30 | Zn + O, 19% Al | No |
| V8 | S4 | 650 | $N_2$ + 2.0% $O_2$ | 815 | $N_2$ + 10% $H_2$ | −10 | −15 | −22 | active | 470 | $N_2$ + 10% $H_2$ | −30 | Zn + O, 19% Al | No |
| V9 | S5 | 650 | $N_2$ + 0.6% $O_2$ | 812 | $N_2$ + 5% $H_2$ | −5 | −14 | −25 | active | 481 | $N_2$ + 5% $H_2$ | −29 | Zn + O, 18% Al | No |
| V10 | S5 | 700 | $N_2$ + 0.8% $O_2$ | 814 | $N_2$ + 5% $H_2$ | −9 | −15 | −22 | active | 480 | $N_2$ + 5% $H_2$ | −27 | Zn + O, 9% Al + 0.9% Mg | No |
| V11 | S6 | 695 | $N_2$ + 1.5% $O_2$ | 832 | $N_2$ + 5% $H_2$ | −3 | −12 | −22 | active | 481 | $N_2$ | −28 | Zn + O, 12% Al | Yes |
| V12 | S6 | *) | $N_2$ | 835 | $N_2$ + 5% $H_2$ | −15 | −29 | −44 | off | 475 | $N_2$ | −28 | Zn + O, 12% Al | Yes |
| V13 | S7 | 685 | $N_2$ + 1.2% $O_2$ | 760 | $N_2$ + 5% $H_2$ | −5 | −14 | −22 | active | 678 | $N_2$ | −50 | Al + 11.5% Si | No |
| V14 | S7 | 670 | $N_2$ + 1.2% $O_2$ | 765 | $N_2$ + 5% $H_2$ | −6 | −18 | −24 | active | 680 | $N_2$ | −50 | Al + 11.5% Si | No |

*)no pre-oxidation was carried out.

TABLE 3

| Test | Inventive | Result |
|---|---|---|
| V1 | Yes | Good wetting and adhesion |
| V2 | Yes | Good wetting and adhesion |
| V3 | Yes | Good wetting and adhesion |
| V4 | No | Impaired wetting and adhesion |
| V5 | Yes | Good wetting and adhesion |
| V6 | No | Impaired wetting |
| V7 | No | Impaired wetting and adhesion |
| V8 | Yes | Good wetting and adhesion |
| V9 | Yes | Good wetting and adhesion |
| V10 | Yes | Good wetting and adhesion |
| V11 | Yes | Good wetting and adhesion |
| V12 | No | Impaired wetting and adhesion |
| V13 | Yes | Good wetting and adhesion |
| V14 | Yes | Good wetting and adhesion |

The invention claimed is:

1. A method for producing a flat steel product provided with a metal protective layer by way of hot dip coating, comprising the following steps:

a) providing a cold- or hot-rolled flat steel product which in addition to Fe and unavoidable impurities (in % by weight) comprises up to 35.0% Mn, up to 10.0% Al, up to 10.0% Si, up to 5.0% Cr, up to 2.0% Ni, up to 0.5% Ti, up to 0.5% V, up to 0.5% Nb, up to 0.5% Mo, up to 0.1% S, up to 0.1% P, up to 0.1% N, up to 1.0% C, and optionally 0.0005-0.01% B;

b) optional cleaning of the flat steel product, c) heating the flat steel product to a 600-1,100° C. holding temperature, wherein heating c.1) occurs within a heating time of 5-60 s;

c.2) in a direct fire pre-heating furnace;

c.3) wherein the furnace comprises a pre-oxidation section in which the flat steel product has a pre-oxidation temperature of 550-850° C., and the flat steel product is exposed for 1-15 s to an pre-oxidation atmosphere with an oxygen content of 0.01-3.0 vol. %, which by blowing a stream of gas containing oxygen into a flame of at least one burner associated with the pre-oxidation section is introduced into the pre-oxidation atmosphere to form a covering FeO layer on the surface of the flat steel product;

c.4) whereas outside of the pre-oxidation section an atmosphere prevails in the pre-heating furnace which is reducing or neutral with respect to the surface of the steel and comprises N2, 5-15 vol. % $CO_2$, 0.1-2.0 vol. % CO, and up to 10 vol. % $H_2$, up to 10 vol. % $O_2$, and up to 10 vol. % $H_2O$, and in total at most 10 vol. % $H_2$, $O_2$, and $H_2O$;

d) recrystallizing annealing of the flat steel product by holding the flat steel product at the holding temperature in an annealing furnace for a holding period of 30-120 s, the product then being passed through the pre-heating furnace to bring about recrystallization of the flat steel product, wherein d.1) an annealing atmosphere prevails in the annealing furnace which has a reducing effect with respect to FeO and comprises 0.01-85.0 vol. % $H_2$, up to 5 vol. % $H_2O$, up to 0.01 vol. % $O_2$, and up to 0.01 vol. % $N_2$, and d.2) the annealing atmosphere has a dew point held between −40° C. and +25° C. over the entire path of the flat steel product through the annealing furnace wherein losses or irregularities in moisture distribution of the annealing atmosphere are compensated by supplying moisture using at least one humidifier;

e) cooling the flat steel product to a bath entry temperature of 430-800° C., wherein cooling occurs under a cooling atmosphere which comprises up to 100% of $N_2$ and optionally further comprise $H_2$ and unavoidable impurities;

f) optional holding of the flat steel product for 5-60 s at the bath entry temperature and under the cooling atmosphere;

g) introducing the flat steel product into a molten bath whose temperature is 420-780° C., wherein the cooling atmosphere is maintained in a transition region to the molten bath and the cooling atmosphere has a dew point adjusted to −80° C. to −25° C.;

h) passing the flat steel product through the molten bath and adjusting the thickness of the metal protective layer on the flat steel product issuing from the molten bath, i) optional heat treatment of the flat steel product provided with the metal protective layer.

2. The method according to claim 1, wherein the heating time is 5-30 s.

3. The method according to claim 1, wherein the pre-oxidation temperature is 600-700° C.

4. The method according to claim 1, wherein the at least one burner associated with the pre-oxidation section is operated with an excess of $O_2(\lambda>1)$.

5. The method according to claim 1, wherein the stream of gas containing oxygen is introduced into the flame of the burner associated with the pre-oxidation section by a jet nozzle which directs a concentrated, guided gas jet into the flame.

6. The method according to claim 1, wherein at least two burners are associated with the pre-oxidation section.

7. The method according to claim 1, wherein a direct flame impingement booster is used as the burner, in which at least one burner ramp is associated with a top or a bottom of the fiat steel product.

8. The method according to claim 1, wherein the holding temperature is 750-850° C.

9. The method according to claim 1, wherein the annealing furnace is a radient tube furnace.

10. The method according to claim 1, wherein the annealing atmosphere during holding contains 3.0-10.0 vol. % $H_2$, up to 5 vol. % $H_2O$ less than 0.01 vol. % $O_2$ and less than 0.01 vol. % $N_2$.

11. The method according to claim 1, wherein the dew point of the annealing atmosphere is held between −30° C. and 0° C. over the entire path of the flat steel product through the annealing furnace.

12. The method according to claim 1, wherein the at least one humidifier is arranged adjacent to a outlet of the annealing furnace and a flow of gas, which is directed in the direction of an entrance to the annealing furnace, and flows through the annealing furnace.

13. The method according to claim 1, wherein water vapor or humidified $N_2$ gas with optional $H_2$ contents is used as a carrier medium for feeding the moisture through the humidifier.

14. The method according to claim 1, wherein, in a region of transition from the pre-heating furnace to the annealing furnace, a flow of gas containing $O_2$ is introduced to react with $H_2$, which has penetrated into this region from the annealing furnace.

15. The method according to claim 1, wherein the cooling atmosphere contains a maximum of 10.0 vol. % $H_2$.

* * * * *

UNITED STATES PATENT AND TRADEMARK OFFICE

CERTIFICATE OF CORRECTION

PATENT NO. : 9,096,919 B2
APPLICATION NO. : 14/232089
DATED : August 4, 2015
INVENTOR(S) : Marc Blumenau et al.

It is certified that error appears in the above-identified patent and that said Letters Patent is hereby corrected as shown below:

In the Claims

Column 14, Line 29, Claim 1, delete "N2," and insert -- $N_2$, --

Column 15, Line 18, Claim 7, delete "fiat" and insert -- flat --

Column 15, Line 24, Claim 9, delete "radient" and insert -- radiant --

Signed and Sealed this
Nineteenth Day of July, 2016

Michelle K. Lee

Michelle K. Lee
*Director of the United States Patent and Trademark Office*